US005673521A

United States Patent [19]

Coulton et al.

[11] Patent Number: 5,673,521

[45] Date of Patent: Oct. 7, 1997

[54] ROLLED ROOF VENT AND METHOD OF MAKING SAME

[75] Inventors: Michael S. Coulton, Lansdale; Geoffrey N. Ehrman, Doylestown; William F. Horvath, Drexel Hill; Kenneth L. Laubsch, Chalfont; Joseph DeMeo, Newtown Square, all of Pa.

[73] Assignee: Benjamin Obdyke Incorporated, Warminster, Pa.

[21] Appl. No.: 609,288

[22] Filed: Mar. 1, 1996

Related U.S. Application Data

[63] Continuation-in-part of Ser. No. 357,702, Dec. 16, 1994.

[51] Int. Cl.[6] ..... E04B 7/00

[52] U.S. Cl. ..... 52/199; 52/198; 52/252; 454/365; 126/671

[58] Field of Search ..... 52/199, 242, 250, 52/252, 198; 126/671; 454/365

[56] References Cited

U.S. PATENT DOCUMENTS

| | | |
|---|---|---|
| 2,200,031 | 5/1940 | Lee . |
| 2,214,183 | 9/1940 | Seymour . |
| 2,704,500 | 3/1955 | Bonforte . |
| 3,236,170 | 2/1966 | Meyer et al. . |
| 3,660,955 | 5/1972 | Simon . |
| 3,949,657 | 4/1976 | Sells . |
| 4,280,399 | 7/1981 | Cunning . |
| 4,701,197 | 10/1987 | Thornton et al. . |
| 4,876,950 | 10/1989 | Rudeen . |
| 4,942,699 | 7/1990 | Spinelli . |
| 5,094,041 | 3/1992 | Kasner et al. . |
| 5,167,579 | 12/1992 | Rotter . |
| 5,174,076 | 12/1992 | Schiedegger et al. . |
| 5,425,672 | 6/1995 | Rotter . |

FOREIGN PATENT DOCUMENTS

| | | |
|---|---|---|
| 2186898 | 2/1987 | United Kingdom . |

*Primary Examiner*—Wynn E. Wood
*Assistant Examiner*—W. Glenn Edwards
*Attorney, Agent, or Firm*—Howson and Howson

[57] ABSTRACT

An improved roll-form vent for buildings comprises a sequentially thermoformed polymeric vent which provides multiple venting air flow paths between the interior of a building and ambient atmosphere. The vent includes projections extending from a web and a plurality of vent openings that cooperate with screening to bar entry into the building of water, insects and foreign matter. A method of making the vent includes steps of providing a web of material of indeterminate running length, heating the web, sequentially thermoforming the web, cooling the web and rolling the formed vent for storage, shipment and use.

17 Claims, 6 Drawing Sheets

FIG. 2
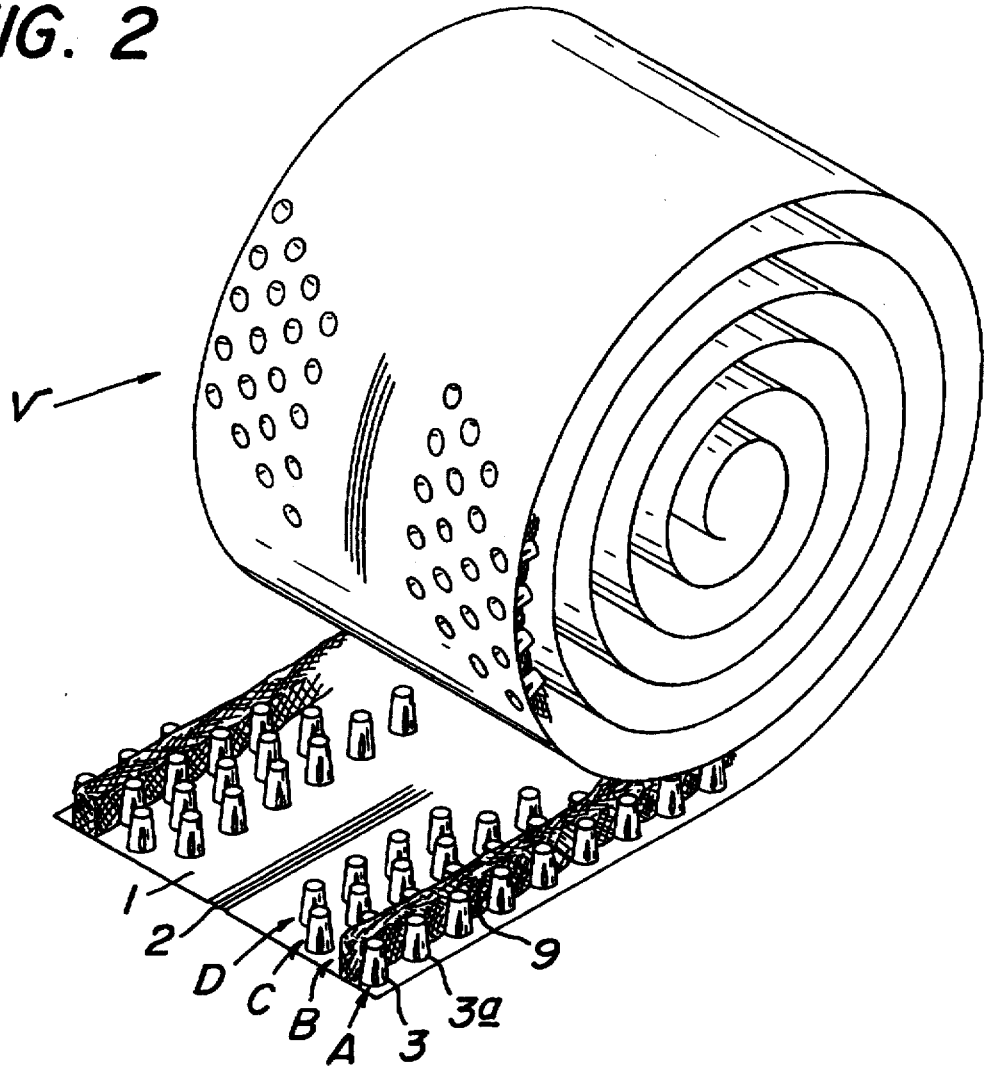
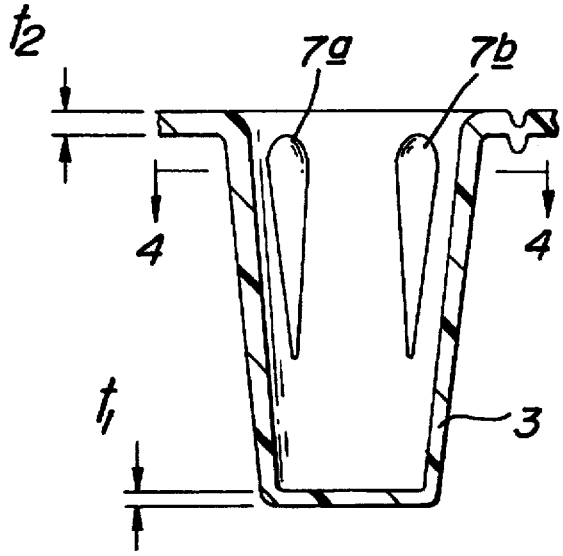
FIG. 3

ROLLED ROOF VENT AND METHOD OF MAKING SAME

CROSS REFERENCE TO RELATED APPLICATION

The present application is a continuation-in-part of copending application Ser. No. 08/357,702 filed Dec. 16, 1994.

FIELD OF THE INVENTION

This invention relates to a roof vent for use in building construction, and to a method of making such a vent. More particularly, this invention relates to a rolled roof vent for enhancing the circulation of air in the space between a roof and the underlying ceiling structure, and to a method of making such a vent by sequentially thermoforming sections into a roll of indeterminate length.

BACKGROUND OF THE INVENTION

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. To accomplish the desired circulation in roof constructions, venting means have been provided in the upper region of the attic area.

It has long been a conventional practice to employ sheet metal vents in and spaced along the peak of a roof, alone or in conjunction with vents in the side walls of the building. In roofs of any substantial length, it is common practice to install one or more sheet metal vents, and not uncommon to provide a powered fan assist to improve air circulation. These means involve a considerable expense, not only for the vents themselves, but in the labor costs incident to their installation.

These shortcomings have been previously recognized. In U.S. Pat. No. 4,280,399, for example, a corrugated roof vent was proposed. This vent extends lengthwise of and is secured to the portions of the roof near the peak. Cap shingles are then secured in place, spaced above the roof portions. Air is thus vented from the attic area through spacing provided by the vent.

In U.S. Pat. No. 4,942,699, assigned to the assignee of the present invention, an improved vent was disclosed in which an opening along the peak of a roof is covered by a matting, or matrix, of randomly convoluted polymeric filaments, heat bonded to a porous sheet material layer. Such a vent permits the flow of ventilating air through the opening and from beneath a row of cap shingles placed on the vent, and can be provided in roll form, for ready installation in any desired length.

U.S. Pat. No. 5,174,076 discloses a roof vent fabricated from a discrete length of injection molded plastic material. While this vent product may provide adequate venting, it suffers from the limitation that, being injection molded, it cannot be fabricated in an indeterminate length suitable for a continuously rolled product. A rolled vent is desirable because it facilitates installation since the vent need merely be unrolled, fastened and cut to length. Another limitation is the cost of manufacturing the injection molded product.

Other ridge cap vents are disclosed in the following U.S. Pat. Nos. 4,280,399; 4,876,950; 5,094,041; 5,167,579; 5,425,672 and published Great Britain Application 2186898A. An example of non-woven filter material is disclosed in U.S. Pat. No. 4,701,197.

While the products disclosed in the above-mentioned patents may function satisfactorily under certain circumstances, there is a need for a roof vent which can be manufactured efficiently by conventional thermoforming molding equipment and formed into a roll for shipping and subsequent installation.

OBJECTS OF THE INVENTION

With the foregoing in mind, it is an object of this invention to provide an effective and economical vent for a building, and a method of making such a vent.

Another object of this invention is to provide a thermoformed air transfer roof vent capable of preventing the entry into the building of water, blowing snow, insects and other foreign matter.

Another object of this invention is to provide a compression-resistant, air-permeable air transfer roof vent, which may be made readily in a continuous form with a thermoforming or vacuum forming apparatus, and may be supplied to installers and users in roll form for convenient and easy installation.

A further object of this invention is to attain the foregoing ends in a manner requiring labor skills possessed by the average roof installer.

SUMMARY OF THE INVENTION

More specifically, the present invention provides a roof vent, comprising: a continuous, indeterminate-length rolled web composed of a series of sequentially-thermoformed integral longitudinal sections of thermoformable material. Each section has a plurality of incompressible spacer elements projecting in spaced relation from the web for spacing the web from the roof when installed thereon. The elements are separated from one another lengthwise along the web to permit the web to be rolled lengthwise into a spiral roll during manufacture and unrolled lengthwise during installation. The elements are hollow and integral with the web, and they have a wall thickness which is thinner than said web as a result of having been drawn therefrom during thermoforming. Preferably, screening is interposed among the spacer elements lengthwise of the web on opposite sides of its longitudinal median to prevent ingress of foreign objects.

When installed, the vent spaces a cap (such as a ridge cap) from the roof surface to provide a venting flow path for air between the interior of the building and the ambient atmosphere. The present vent is characterized by thermoformed projections and screening or baffles which provide multiple flow paths through the vent. The vent is self-supporting and has a composite strength in compression sufficient to support an overlying cap. It is sequentially thermoformed in an in-line operation using commercially-available apparatus.

The geometry of the vent, particularly the disposition, number and dimensions of its projections, screening and baffles, determines the overall air permeability of the vent. The integral baffles and screening provide a weather barrier and a barrier to insects and foreign matter. The projections and baffles can be staggered or otherwise so oriented that they absorb the energy of incoming water. Thus, the projections, baffles and screening prevents wind-driven rain and snow, and insects and other foreign matter, from entering the building through the vent.

BRIEF DESCRIPTION OF THE DRAWINGS

The foregoing and other objects, features, and advantages of the invention should become apparent from the following description taken in conjunction with the following drawings in which:

FIG. 2 is a perspective view of a rolled roof vent embodying the present invention;

FIG. 3 is a greatly enlarged longitudinal sectional view illustrating one of the roof vent spacer elements;

DETAILED DESCRIPTION OF THE PREFERRED EMBODIMENT

Figure 1:
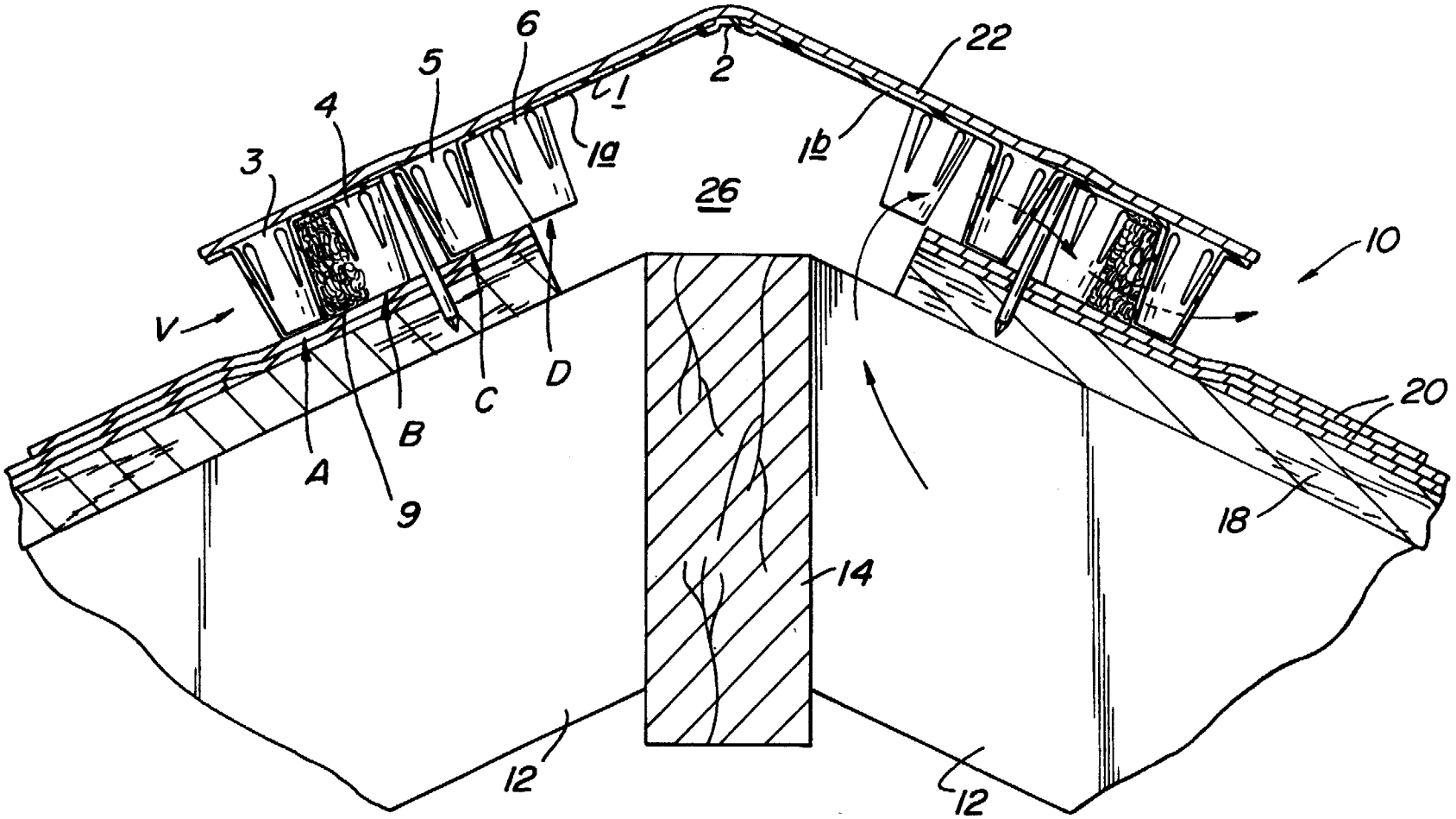
FIG. 1 is a sectional view transverse to a roof ridge line illustrating a rolled ridge vent embodying the invention installed on a roof.

Referring now to the drawings, FIG. 1 illustrates a roof, designated generally by the reference numeral 10, comprising a plurality of rafters 12, conventionally supported at their lower ends by the front and rear walls of the building. The upper ends of the rafters 12 meet at, and may be attached to, a ridge pole 14, which extends between the end walls of the building.

The roof deck 18, typically comprising plywood or other suitable panels, make up the outer sheathing of the building. The roof deck 18 is secured to the rafters 12 and extends to the end walls.

Shingles 20 may be nailed to the roof deck 18 to finish the sloping portions of the roof in accordance with conventional construction practices. Conventional cap shingles 22 may then be installed in overlapping fashion to cover the peak of the roof, above the ridge pole 14.

A slot 26 is provided along the length of the peak of the exemplary roof construction 10 to provide a passageway for venting air between the underlying attic area and the ambient atmosphere. The ends of the slot 26 are spaced from the opposite ends of peak, as seen in FIG. 1. This spacing may typically be on the order of six inches.

In accordance with the present invention, as will be more fully discussed, a vent designated generally by the reference V is interposed between the cap shingles 22 and the underlying portions of the roof construction 10.

Still referring to FIG. 1, the vent V has a web 1 with a longitudinal medial hinge 2 which divides the web 1 lengthwise into a pair of identical portions 1*a* and 1*b* capable of being disposed at a dihedral angle relative to one another. Each web portion, such as the web portion 1*a*, has a plurality of frusto-conical spacer elements 3,4,5,6 disposed in parallel longitudinal rows A,B,C,D, extending along the lengthwise edge margins of the web portions. See FIG. 2. The spacer elements in adjacent rows are offset longitudinally relative to one another so that, for example, a spacer element 4 in row B is located intermediate a pair of spacer elements 3 and 3*a* in row A. A continuous length of screening material 9 is captured between the spacer elements in rows A and B. The screening material permits air to flow outwardly in the manner illustrated by the arrows while preventing flying insects, rain, snow, and blowing foreign objects from entering in the opposite direction. Preferably, the screening material 9 is of spun-bonded non-woven fabric, but it could also be formed of needle-punched, non-woven plastic or metal mesh screen or like structure providing air permeability through small spaces.

The spacer elements 3–6 are designed to resist compression during and after installation while affording ready rolling and unrolling during manufacture and installation. To this end, each spacer element, such as the spacer element 3 (FIG. 3) has a continuous frusto-conical wall formed integral with the web 1 and projecting transversely from the plane of the web. As will be described, the spacer element 3 is thermoformed integral with the web so that, as a result of thermoforming, it has an end wall thickness $t_1$ which is about ½ the wall thickness $t_2$ of the web 1. Each spacer element is provided with a series of recessed ribs 7*a*, 7*b*, disposed at spaced peripheral locations and extending longitudinally of each spacer element wall. In the illustrated embodiment, four such reinforcing recesses are shown spaced apart at 90° included angles relative to one another and extending from a larger base located adjacent the plane of the web 1 to a tapered tip located at about the transverse median of the spacer element. The recesses help to stiffen the wall of the spacer element, which, it is noted becomes thinner as it proceeds away from the plane of the web 1. The number of reinforcing ribs is not critical, but they are preferably disposed symmetrically.

By way of example, and not by way of limitation, each spacer element has a length of about ⅞ inch, a base diameter at the plane of the web of about ½ inch, and an end wall diameter of about ⅜ inch. The spacer elements are located on about 1⅜ inch centers in their rows, and the rows are located on about ⅞ inch centers. The web thickness $t_2$ in FIG. 3 is about 0.045 inches, and the spacer element end wall thickness $t_1$ is about 0.015 inches, or about ⅓ the thickness of the web. These dimensional relations have proven to provide the desired degree of compressive strength and longitudinal flexibility required to form the vent into a roll, as seen in FIG. 1.

Figure 5:
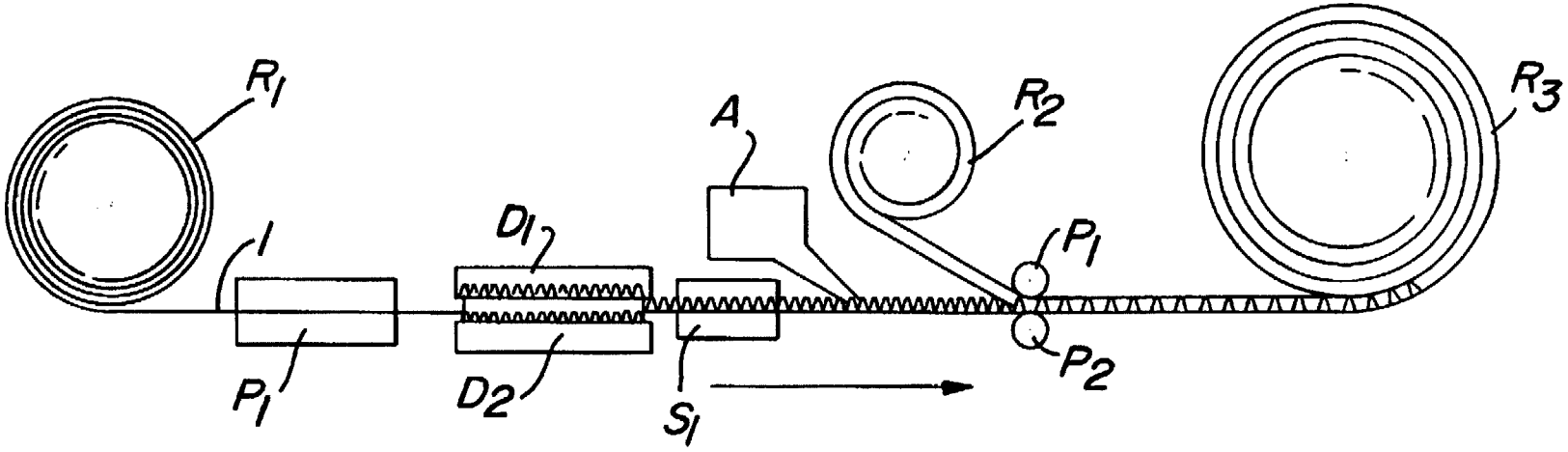
FIG. 5 is a schematic flow diagram illustrating a preferred method for making the roll vent of FIG. 1.
Figure 4:
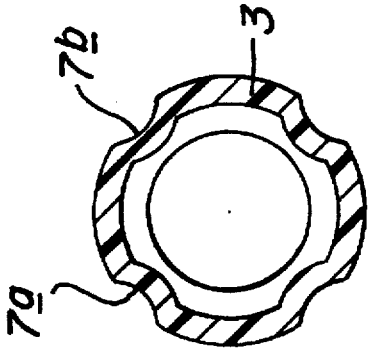
FIG. 4 is a sectional view of the spacer element taken on line 4—4 of FIG. 3.

The vent V is manufactured efficiently by means of a novel process. To the end, as best seen schematically in FIG. 5, the web 1 is unrolled from a planar storage roll $R_1$ and fed longitudinally into a preheat station $P_i$ and then into a thermoform die assembly $D_1$, $D_2$ which cooperates to draw the spacer elements from the plane of the web with the application of negative pressure and heat. Preferably, the die assembly is about 4 feet in length. After one longitudinal section the vent V has been thus thermoformed, it is ejected from the die assembly and passed through a cooling station $S_1$ and then advanced lengthwise a predetermined distance corresponding to the length of the die assembly at which time the lengthwise adjacent section of the web is thermoformed in sequence. This process is repeated to form a continuous length vent V.

The screening 9 is applied in a continuous manner downstream of the thermoforming dies $D_1$, $D_2$. To this end, a bead of suitable adhesive is applied to the topside of the web 1 by an applicator A, and screening is unrolled from a storage roll $R_2$ and pressed into position against the web 1 by opposing pressure rollers $P_1$, $P_2$. Thermal energy, ultrasonic welding or infrared bonding can also be used to bond the screening to the vent.

The sequentially-thermoformed vent V is rolled into a spiral roll $R_3$ of a predetermined diameter, before being cut, and bound for shipping and installation.

Installation is straightforward. After delivery to the construction site, the vent is disposed with its spacer elements facing downward, as shown in FIG. 1, and with its two portions 1*a* and 1*b* angulated as shown. The vent V is then nailed in place, after which the roof caps are applied onto it. The vent is preferably cut to the required length of the roof ridge after having been mounted in place. Thermoformed end caps are used to seal the gable ends of the vent and nailed in place during application of the roof caps.

Figure 6:
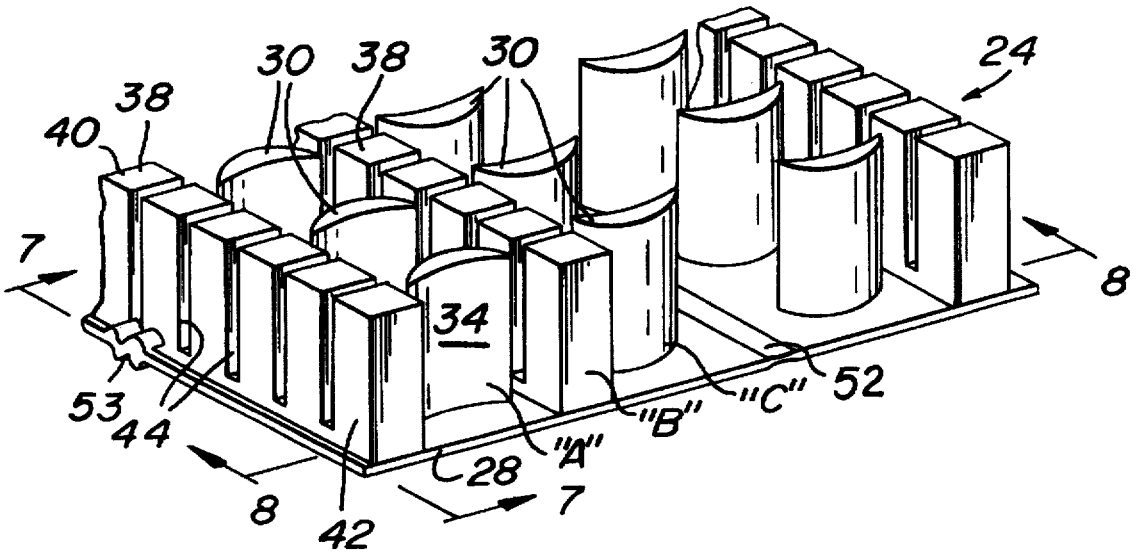
FIG. 6 is a fragmentary pictorial view, showing a portion of a modified embodiment of a roof vent in accordance with the present invention.
Figure 7:
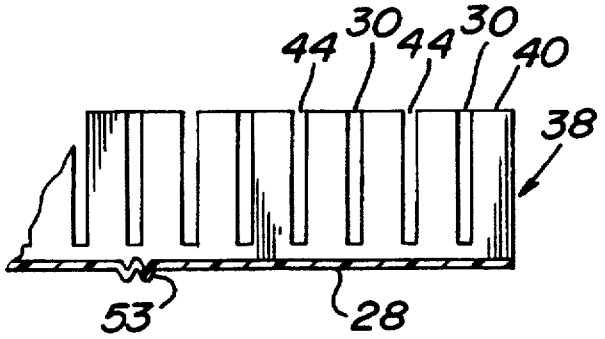
FIG. 7 is a partial cross-sectional view, taken along line 7—7 in FIG. 6.
Figure 8:
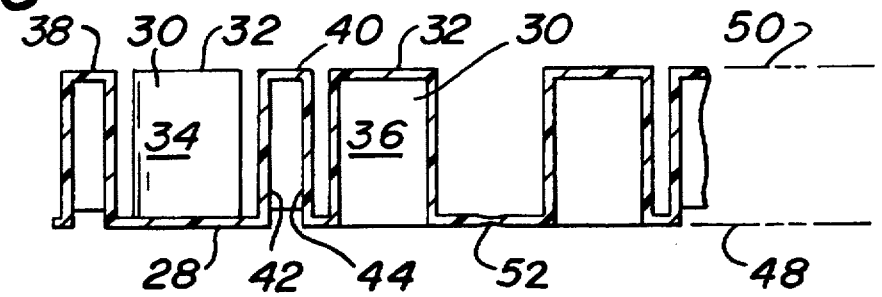
FIG. 8 is a partial cross-sectional view, taken along line 8—8 of FIG. 6.

Referring now to FIGS. 6, 7, and 8, another example of a vent 24 is shown in detail. Like the previously described embodiment, it comprises a backing, or web 28, from which there project a series of projections 30.

Figure 10:
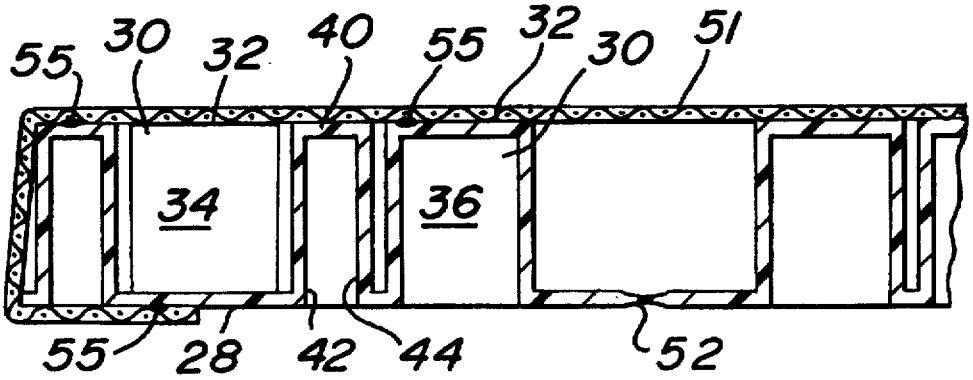
FIG. 10 is a view similar to FIG. 8, but showing an alternative form of a vent in accordance with the present invention.

As with the most preferred embodiment of FIGS. 1–4, each of the projections 30 is hollow and their walls become thinner remote from the web from which they are drawn during thermoforming, although the cross-sections of FIGS. 8 and 10 show constant wall thickness for ease of illustration.

The vent V is self-supporting yet flexible, and has sufficient strength in compression to resist crushing during installation and use and to support the cap shingles 22 or other building elements which overlie the vent when the vent installed.

In the presently preferred forms of the invention, the vents are composed of a web of either high impact polystyrene ("HIPS"); or ABS; or high-density polyethylene (HDPE); or high density polypropylene (HDPP); or PVC; or a blend of any of these suitable polymers shaped preferably by thermoforming, vacuum stamping or other suitable techniques. Other suitable materials can be used. In general, to meet the above-mentioned and other performance criteria, the vent should be made of a tough, compression resistant yet rollable material. Polymers other than those mentioned above, for example, nylon or polyester, could be used.

Referring again to FIGS. 6–8 and also to FIG. 1, the vent is formed from an elongate strip, or web of sheet material, typically of about 0.040 to about 0.050, and preferably about 0.045 inches, in thickness. The selected thickness will vary depending upon the characteristics of the particular material used. The vent is formed, preferably by the above-mentioned longitudinal sectional thermoforming process, so as to have a series of projections 30, projecting from the plane of the web 28. The projections 30 have respective distal end portions 32 and curved side walls 34 and 36.

The projections 30 are arranged, in the illustrated form of the invention, in parallel rows "A", "B", "C", etc., extending in one dimension of the base 28. Also projecting from the base 28, and parallel to the rows of projections 30, are blade-like ridges, or baffles, 38. The ridges 38 have respective distal end walls 40 and side walls 42, and in the illustrated form of the invention have slots 44 (seen in FIGS. 6–8) in their end walls 40 and side walls 42.

Referring to FIG. 8, it will be seen that the base 28 from which the projections 30 and ridges 38 project, defines, in a sense, a first face 48, while the distal end portions 32 of the projections 30 and end walls 40 of the ridges 38 may be taken to define a plane providing a second face, depicted in FIG. 8 and designated by the reference numeral 50, spaced from the first face 48.

In the exemplary arrangement shown in FIGS. 6–8, the projections 30 and ridges 38 are approximately ⅞ inch high. The projections 30 are lenticular in cross-section, so as to direct air exiting from the side of the vent into curvilinear paths, and are approximately 1.6 inches in width. The ridges 38 are spaced from the edges of the projections 30 by about ¼ inch, and the ridges are ½ inch wide. The slots 44 are about ¼ inch wide and spaced from one-another along the ridges by about ⅛ inch. Other dimensions can of course be used.

When assembled as described below, the vent 24 in association with the cap shingles 22 permits the flow of air through the openings provided by the slots 46, as with the FIG. 1–4 embodiment, while the projections 30 act as baffles, preventing wind driven precipitation and foreign matter from reaching and penetrating the slot 26.

Figure 9:
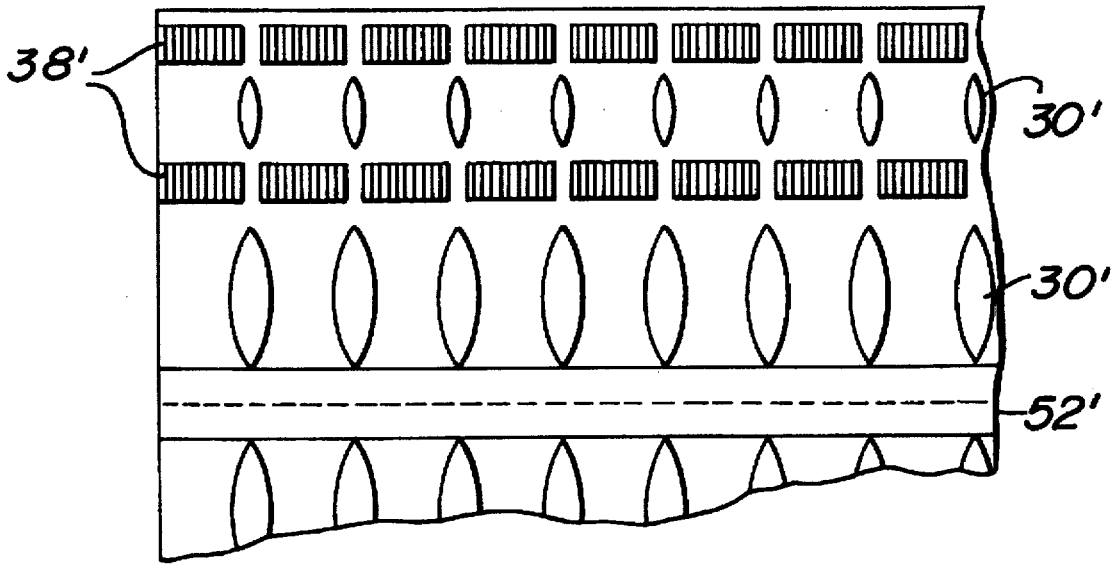
FIG. 9 is a top plan view of an alternative form of a roof vent embodying the present invention.

The projections 30 can have a variety of arrangements or configurations. The projections 30 may be formed in staggered rows, for example, or disposed in curvilinear patterns, to absorb the energy of incoming water. The projections 30 can also be angled with respect to one-another to form Z-configurations (when seen in plan view). Other configurations and arrangements of the projections 30 and ridges 38 may, of course, occur to those skilled in the art. One such alternative arrangement, utilizing projections 30' of varying sizes and cross-sections, and discontinuous ridges 38', is shown in FIG. 9. Alternatively, if weather conditions do not require it or a fabric overwrap is used (as described below), the ridges 38' may be replaced with a row of cones 38" (FIG. 13), or pyramid shapes, projecting from web 28", to increase structural rigidity of the vent. See FIGS. 9–13.

Figure 11:
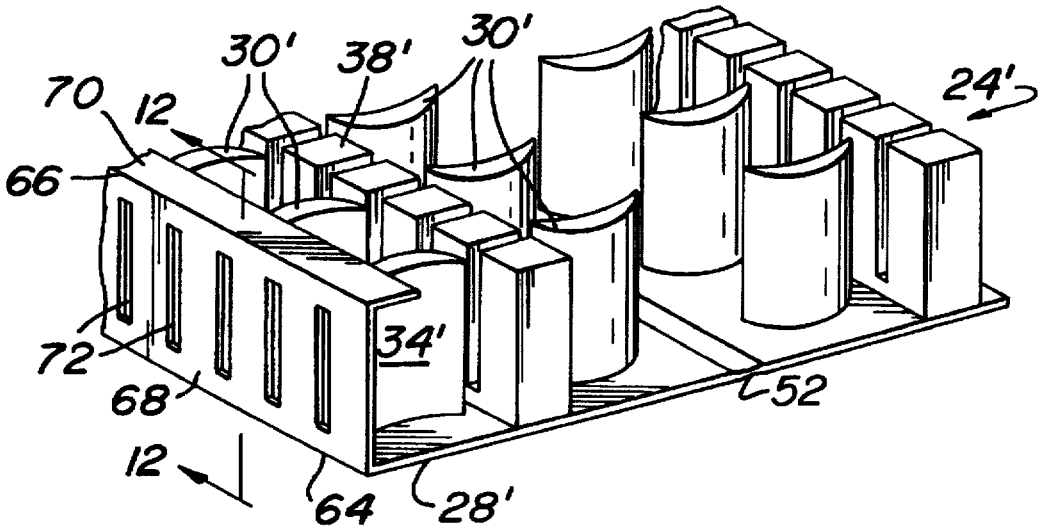
FIG. 11 is a view similar to FIG. 6, but illustrating a further modified embodiment of the invention.
Figure 12:
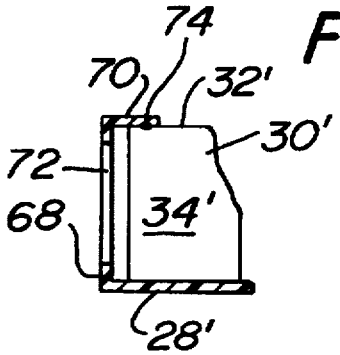
FIG. 12 is a fragmentary view of a portion of the vent illustrated in FIG. 11.
Figure 13:
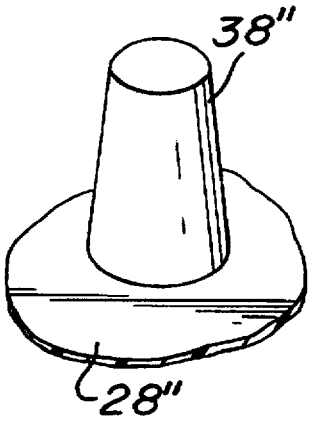
FIG. 13 is a fragmentary perspective view of a modified spacer element.

FIGS. 11–13 illustrate another alternate embodiment of a roof vent, in which elements corresponding to those previously described are designated by like, prime (′), reference numerals. In this embodiment, there are provided on the vent web 24', in addition to the above-mentioned hinge 52, an outboard pair of hinges 64 and 66. Defined between the hinges 64 and 66 is a panel or flange 68, and outboard of the panel or flange, 68 is a distal panel 70. The panel 68 is perforated by a series of apertures 72. As is perhaps best seen in FIG. 12, the panel 68 and distal panel 70, which together form an edge of the vent 24, are folded over by means of the respective hinges 64 and 66, and the distal panel 70 secured to the end portions 32' of the projections 30' by suitable mechanical (such as thermal bonding, ultrasonic welding, or other means) or adhesive means, as indicated at 74. The panel 68 and distal panel ultrasonic welding or other means 70 thus create, in effect, an integral "C"-channel, increasing the structural rigidity of the vent 24' while providing an integral baffle system.

It should be noted that inboard baffles, such as the ridges 38, can be formed in a manner similar to the above. In other words, three parallel hinges (not shown) could be molded between rows of projections, the material punched, in the manner of the openings 72 in the panel 68, and the material folded back upon itself to form a blade-like ridge.

The vent V, and vent 24, may be provided with an integrally molded hinge, such as the exemplary hinge 52 to facilitate conformity of the vent to a roof peak or other changes in building planes, and to accommodate dimensional changes due to thermal expansion and contraction after installation of the vent. The vent may also be provided with expansion accommodating discontinuities, such as the discontinuties 53 shown in association with vent 24 (FIG. 6) at periodic intervals along its length. In one presently preferred form of the invention, such discontinuities 53 are molded into the base web 28' of the vent at intervals of about every five (5) to six (6) inches of running length. It is desirable to compensate for thermal expansion and contraction in the range of −40° to 160° F. It is preferred for reasons of UV durability that the vent 24 be black, but other colors can obviously be used.

Desirable properties and characteristics of a suitable vent 24, in a presently preferred form of the invention, also include the following: substantial ultraviolet stability (e.g., for 40 years outdoor exposure); substantial tear strength (in excess of 150 psi); cold impact resistance; compression resistance, preferably above about 30 pounds/square inch; a self-ignition temperature of at least 650° F.

In the embodiment of the invention shown in FIG. 10, a fabric wrap 51 overlies the first face 48 of the vent 24, and is wrapped around and covers side edges of the vent 24. The fabric of the wrap 51 is air permeable, to permit substantially free flow of air into the vent 24, around the projections 30 and ridges 38. The fabric of the wrap 51 also provides an additional barrier against water, snow, insects and other foreign matter. A variety of fabrics may be used for the wrap 51. Such fabrics desirably provide long-term UV stability as well as the above-described properties. One suitable fabric is the spunbonded nonwoven fabric sold by BASF Corporation, under the trademark "Colback", grade S-100.

When a wrap-equipped vent 24 is installed, the wrap 51 overlies the slot 26, thus providing a primary barrier for preventing entry of insects or other unwanted matter into the attic area. The wrap 51 is preferably secured to the vent 24 by thermal bonding 55. Alternatively, adhesive may be used. If used, the adhesive is preferably of the rubber-based or acrylic hot melt type. The bonding or adhesive should preferably permit release of the sheet material layer 30 by hand pressure without causing tears in that material.

While the wrap 51 is permeable to air, as is necessary for its venting function, it is also intended that it present a barrier to liquid flow. It is therefore preferred that the wrap 51 be non-wicking, and preferably, hydrophobic. Thus, the tendency of water or water vapor to be drawn into the area of the slot 26, where it could enter the attic or become a source of high humidity capable of damaging the wooden components of the roof, is eliminated.

The combined vent 24 and wrap 51 should, preferably, have self-ignition temperature not substantially below 650° F.

Referring again to FIG. 5, the web material, usually supplied in roll form, is heated to a temperature at which it can be formed. The heated web material is then advanced to a trimming operation (not shown), at which slots may be made and, if necessary, the vent can be trimmed to a desired width. The thus formed vent may then be taken up for storage or shipment in indeterminate lengths, in roll form.

In making the vent 24', the forming operation 58 is performed as above, but in addition, the outboard hinges 64 and 66 are made in the forming operation 58. Punching or another suitable step may be used to make the openings 72. Punching may be associated with the trimming step 60, or may be done as a separate and additional step.

The foregoing steps may be accomplished using commercially available machinery, such as the continuous and cut sheet thermoforming machinery sold under the trademark "BROWN", by John Brown Co. The operations may be controlled, in a known manner, using conventional techniques, including, if desired, computer controls.

It should now be apparent that the above described vent V, spaces the cap shingles 22 above the underlying shingles 20 to provide a venting passageway for the flow of air from the slot 26. The vent V is compression resistant. Thus, the vent V can be nailed to a roof deck 18 (as shown in FIG. 1) without the need for delicate handling or special care.

The material from which the vent V is fabricated should ideally be highly resistant to degradation in an outdoor environment over wide ranges of temperature and humidity.

As has been explained, the vent V, in accordance with the invention may be formed in indeterminate "running lengths". The vent V thus fabricated, is sufficiently flexible in the direction of its running length to readily be coiled in rolls, as is illustrated by the exemplary roll 64 seen in FIG. 2. Providing the vent V in roll form facilitates storage, transportation and installation. Heretofore known molded or thermoformed vent elements have been provided in relatively short sections, not roll form, and thus lack the advantages of the present invention.

Installation of the vent V involves labor costs only slightly greater than those required for the conventional installation of cap shingles. Such costs represent a saving over the installation of conventional roof vents of the type which provide a localized venting flow at points spaced along the length of the peak of the roof, and over vents which are provided in sections, rather than rolls.

Installation may be accomplished generally in the manner described in the above-mentioned U.S. Pat. No. 4,942,600, assigned to the assignee of the present invention (which description is incorporated herein by reference).

It should also be appreciated that venting of building roofs may be required or desired other than at the peak of two sloping roof portions as illustrated. Thus, the present vent V may be installed to space, for example, a cap type shingle or flashing from an angled roof portion which joins a vertical building wall. The vent V may also be used for openings in building structures other than roofs.

It should be understood that the present invention may be embodied in other specific forms without departing from its spirit or essential attributes. Accordingly, reference should be made to the appended claims, rather than to the foregoing specification, for an indication of the scope of the invention.

We claim:

1. A roof vent, comprising: a continuous, indeterminate-length roll-form web, said web being composed of a series of sequentially-thermoformed integral longitudinal sections of thermoformable material, each section having a plurality of spacer elements projecting in spaced relation from said web for spacing said web from a roof when installed thereon, said elements being separated from one another lengthwise of said web to permit the web to be rolled lengthwise into a spiral roll during manufacture and unrolled lengthwise during installation, said elements being hollow and integral with the web and having a wall thickness which is thinner than said web as a result of having been drawn therefrom during thermoforming.

2. A roof vent according to claim 1, wherein said elements are spaced laterally from one another widthwise of the web to define therebetween a pair of lengthwise extending channels disposed on opposite sides of a lengthwise median of said web, and a continuous length air permeable screen mounted in said channels for permitting air to flow across said channels while preventing solid objects from traversing said channel.

3. A roof vent according to claim 2, wherein said screen is of non-woven fabric and is adhered to said web in said channels.

4. A roof vent according to claim 1, wherein said lengthwise median is defined by a hinge forming like web sections on opposite lateral sides thereof, said hinge permitting said web sections to be angulated into a dihedral angle relative to one another for installation on a roof ridge with said elements confronting said roof ridge.

5. A roof vent according to claim 1, wherein each of said elements has a frusto-conical configuration with its base disposed in the plane of the web, and including reinforcing ribs extending lengthwise of each element from a location adjacent said base.

6. A roof vent according to claim 5, wherein said reinforcing ribs taper in a direction away from said base and have a cross-section which is convex inwardly.

7. A roof vent according to claim 6, wherein each of said elements has a length of about 1 inch, a base diameter of about ½ inch, and an end wall thickness of about one-half the thickness of the web.

8. A roof vent according to claim 1, wherein said thermoformable material is selected from the group of materials consisting of: high impact polystyrene; or ABS; or high-density polyethylene (HDPE); or high density polypropylene (HDPP); or PVC; or a blend of any of these suitable polymers.

9. A roof vent according to claim 1, wherein said elements are disposed on the inside of said web when said web is formed into a roll.

10. A roof vent according to claim 1 wherein said projections are disposed in parallel rows and are aligned widthwise of the web with lengthwise-extending gaps therebetween, and including a plurality of baffles formed in said web and extending between said parallel rows of projections to prevent air from flowing directly across the web and through the gaps between transversely aligned projections.

11. A roof vent according to claim 10 wherein said baffles are arcuate in shape.

12. A roof vent according to claim 11 including a second plurality of baffles formed in a longitudinal row between one of said rows of projections and the longitudinal median of the web.

13. A roof vent according to claim 1 including a pair of flanges extending along opposite longitudinal edges of said web and along said projections, and a series of apertures in spaced relation in each flange sized to prevent ingress of flying insects into the vent.

14. A roof vent accordingly to claim 13 wherein each of said flanges has an inturned lip.

15. A continuous, indeterminate-length, roll-form roof vent, comprising a thermoformable web composed of a series of sequentially-thermoformed integral longitudinal sections, each section having a plurality of tapered spacer elements projecting in spaced relation from said web for spacing said web from a roof when installed thereon, said elements being separated from one another lengthwise of said web to permit the web to be rolled lengthwise into a spiral roll during manufacture and unrolled lengthwise during installation, said elements being hollow and integral with the web and having a wall thickness which is thinner than said web as a result of having been drawn therefrom during thermoforming, said elements being spaced laterally from one another widthwise of the web to define therebetween a pair of lengthwise extending channels disposed on opposite sides of a hinge extending lengthwise medially of said web, and means for preventing solid objects from traversing said channel while permitting gas to flow thereacross.

16. A continuous, indeterminate-length, roll-form roof vent, comprising a thermoformable web composed of a series of sequentially-thermoformed integral longitudinal sections, each section having a plurality of spacer elements projecting in spaced relation from said web for spacing said web from a roof when installed thereon, said elements being separated from one another lengthwise of said web to permit the web to be rolled lengthwise into a spiral roll during manufacture and unrolled lengthwise during installation, said elements being hollow and integral with the web and having a wall thickness which is thinner than said web as a result of having been drawn therefrom during thermoforming, said elements being spaced laterally from one another widthwise of the web to define therebetween a pair of lengthwise extending channels disposed on opposite sides of a lengthwise median of said web, and a series of hollow baffles disposed between laterally-adjacent elements to prevent solid objects from traversing directly across said channels while permitting gas to flow in a serpentine path thereacross.

17. A continuous, indeterminate-length, roll-form roof vent, comprising a thermoformable web composed of a series of sequentially-thermoformed integral longitudinal sections, each section having a plurality of spacer elements projecting in spaced relation from said web for spacing said web from a roof when installed thereon, said elements being separated from one another lengthwise of said web to permit the web to be rolled lengthwise into a spiral roll during manufacture and unrolled lengthwise during installation, said elements being hollow and integral with the web and having a wall thickness which is thinner than said web as a result of having been drawn therefrom during thermoforming, and a pair of flanges extending along lengthwise edges of said web alongside said spacer elements, said flanges having a series of apertures sized to afford flow of gas but to preclude entry of winged insects.

* * * * *